United States Patent [19]

Ikeda

[11] Patent Number: 4,992,115

[45] Date of Patent: Feb. 12, 1991

[54] SURFACE TREATMENT CHEMICAL AND BATH FOR ALUMINUM AND ITS ALLOY

[75] Inventor: Satoshi Ikeda, Yamato, Japan

[73] Assignee: Nippon Paint Co., Ltd., Osaka, Japan

[21] Appl. No.: 310,569

[22] Filed: Feb. 15, 1989

[30] Foreign Application Priority Data

Feb. 15, 1988 [JP] Japan ..... 63-33755
Jul. 15, 1988 [JP] Japan ..... 63-177672

[51] Int. Cl.[5] ..... C23C 22/36
[52] U.S. Cl. ..... 148/247; 148/261
[58] Field of Search ..... 148/247

[56] References Cited

U.S. PATENT DOCUMENTS 4,148,670 4/1979 Kelly .
4,264,378 4/1981 Oppen et al. .
4,470,853 9/1984 Das ..... 148/247

FOREIGN PATENT DOCUMENTS 3236247 4/1984 Fed. Rep. of Germany ..... 148/247

*Primary Examiner*—Sam Silverberg
*Attorney, Agent, or Firm*—Sughrue, Mion, Zinn, Macpeak & Seas

[57] ABSTRACT

A surface treatment chemical for aluminum or its alloy comprising 10–1000 parts by weight of vanadium or cerium ion, 10–500 parts by weight of zirconium ion, 10–500 parts by weight of phosphate ion and 1–50 parts by weight of effective fluorine ion. A surface treatment bath for aluminum or its alloy comprising 10–1000 ppm of vanadium or cerium ion, 10–500 ppm of zirconium ion, 10–500 ppm of phosphate ion and 1–50 ppm of effective fluorine ion, and having pH of 2.0–4.0.

10 Claims, 1 Drawing Sheet

SURFACE TREATMENT CHEMICAL AND BATH FOR ALUMINUM AND ITS ALLOY

BACKGROUND OF THE INVENTION

The present invention relates to a chemical or bath for surface-treating aluminum or its alloy, and more particularly to a surface treatment chemical or bath suitable for the surface treatment of aluminum cans for drinks.

Aluminum and its alloy are conventionally subjected to a chemical treatment to provide them with corrosion resistance and to form undercoating layers thereon. A typical example of such chemical treatment is a treatment with a solution containing chromic acid, phosphoric acid and hydrofluoric acid. This method can provide a coating having high resistance to blackening by boiling water and high adhesion to a polymer coating film formed thereon. However, since the solution contains chromium [VI], it is hazardous to health and also causes problems of waste water treatment. Thus, various surface treatment solutions containing no chromium [VI] have already been developed.

For instance, Japanese Patent Laid-Open No. 48-27935 discloses a method of treating aluminum or its alloy with a solution of pH of 3–5 which contains a water-soluble zinc salt, a water-soluble vanadate, a water-soluble fluoride or fluorine complex salt, an oxyacid salt of halogen as an oxidizing agent, etc. Japanese Patent Laid-Open No. 55-131176 discloses a method of surface-treating a metal [particularly aluminum] with a phosphate treating solution of pH 1.5–3.0 containing vanadate ion. Japanese Patent Publication No. 56-33468 discloses a coating solution for the surface treatment of aluminum, which contains zirconium, phosphate and an effective fluoride and has pH of 1.5–4.0. Further, Japanese Patent Laid-Open No. 56-136978 discloses a chemical treatment solution for aluminum or its alloy containing a vanadium compound, and a zirconium compound or a silicon fluoride compound.

However, in the method disclosed in Japanese Patent Laid-Open No. 48-27935, treating time is as long as 3–10 minutes, meaning poor efficiency, and the formed coating layer is turned gray, unsuitable for aluminum cans for drinks. Further, the conversion coating produced by this method does not have sufficient adhesion to a polymer coating film of paint, ink, lacquer, etc.

With respect to the method disclosed in Japanese Patent Laid-Open No. 55-131176, since it is a non-rinse method, it is not applicable to cans for drinks. In addition, the formed conversion coating tends to be blackened by treatment with boiled water for sterilization. Further, the coating layer does not have satisfactory adhesion to a painted coating layer.

With respect to the coating solution disclosed in Japanese Patent Publication No. 56-33468, it shows sufficient properties when it is a fresh solution, namely a newly prepared solution. However, after repeated use for chemical treatment, aluminum is accumulated in the solution by etching of the aluminum plates or sheets with fluorine. A conversion coating produced by such a coating solution does not show high resistance to blackening by boiling water and good adhesion to a polymer coating film. In addition, the formed conversion coating does not have good slidability, so cans treated with this solution cannot smoothly be conveyed.

Further, the treatment solution disclosed in Japanese Patent Laid-Open No. 56-136978 needs a treatment at a relatively high temperature for a long period of time, preferably at 50°–80° C. for 3–5 minutes, and the formed conversion coating does not have sufficient resistance to blackening by boiling water and sufficient adhesion to a polymer coating film. In addition, since the formed conversion coating is grayish, it cannot be suitably applied to aluminum cans for drinks.

OBJECT AND SUMMARY OF THE INVENTION

Accordingly, an object of the present invention is to provide a surface treatment chemical for aluminum or its alloy free from the above problems inherent in the conventional techniques, which makes it possible to conduct a surface treatment at a low temperature in a short time to provide a conversion coating excellent in resistance to blackening by boiling water, adhesion to a polymer coating film formed thereon and slidability.

Another object of the present invention is to provide a surface treatment bath for aluminum or its alloy having such characteristics.

As a result of intense research in view of the above objects, the inventors have found that a combination of particular proportions of vanadium or cerium ion, zirconium ion, phosphate ion and effective fluorine ion can provide a surface treatment chemical and bath free from any problems of the conventional techniques. The present invention is based on this finding.

Thus, the surface treatment chemical for aluminum or its alloy according to the present invention comprises 10–1000 parts by weight of vanadium or cerium ion, 10–500 parts by weight of zirconium ion, 10–500 parts by weight of phosphate ion and 1–50 parts by weight of effective fluorine ion.

The surface treatment bath for aluminum or its alloy according to the present invention comprises 10–1000 ppm of vanadium or cerium ion, 10–500 ppm of zirconium ion, 10–500 ppm of phosphate ion and 1–50 ppm of effective fluorine ion, and has a pH of 2.0–4.0.

DETAILED DESCRIPTION OF THE INVENTION

Figure 1:
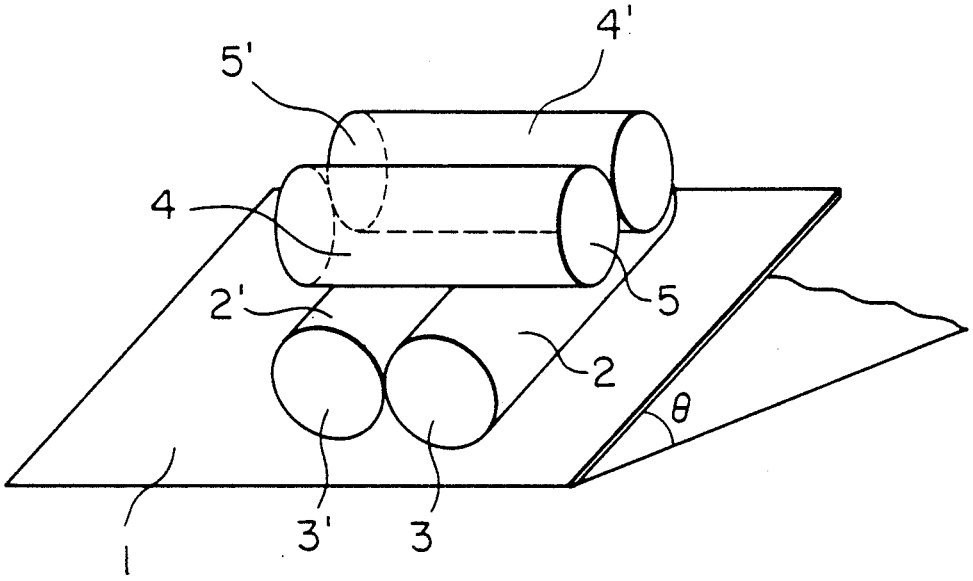
FIG. 1 is perspective view showing a method of measuring the slidability of coated cans.

The surface treatment chemical of the present invention contains a particular proportions of substances suitable for surface treatment of aluminum or its alloy, and it is diluted to a proper concentration as a surface treatment bath. Specifically, it contains 10–1000 parts by weight of vanadium or cerium ion [10–1000 ppm as a concentration in a surface treatment bath, same in the following]. When the content of the vanadium ion is less than 10 parts by weight [10 ppm], the formed conversion coating is turned black when treated with boiling water for sterilization, meaning that it is poor in resistance to blackening by boiling water. Further, it is poor in adhesion to a polymer coating film formed by painting, printing, etc. and in slidability. On the other hand, when the vanadium ion exceeds 1000 parts by weight [1000 ppm], further improvement due to the addition of vanadium ion cannot be obtained. Thus, from the economic point of view, 1000 parts by weight [1000 ppm] of vanadium ion is sufficient. The preferred content of vanadium ion is 25–500 parts by weight [25–500 ppm], and more preferably 25–200 parts by weight [25–200 ppm]. Sources of vanadium ion include vanadic acid and its salts such as $HVO_3$, $NH_4VO_3$, $NaVO_3$, etc., vanadyl salts such as vanadyl sulfate, vanadyl oxalate, vanadium halides such as $VF_5$, etc. Particularly, $NH_4VO_3$ is preferable.

In the case of cerium ion, its content in the surface treatment chemical [surface treatment bath] is 10–1000 parts by weight [10–1000 ppm]. The reasons for limiting the content of cerium ion is essentially the same as those for vanadium ion. That is, when it is less than 10 parts by weight [10 ppm], the formed conversion coating is turned black when treated with boiling water for sterilization, meaning that it is poor in resistance to blackening by boiling water. Further, it is poor in adhesion to a polymer coating film and slidability. On the other hand, further improvement of resistance to blackening by boiling water and adhesion to a polymer coating film cannot be achieved by the addition of cerium ion in an amount exceeding 1000 parts by weight [1000 ppm]. Accordingly, from the economic point of view, up to 1000 parts by weight [1000 ppm] is sufficient. The content of cerium ion is preferably 25–500 parts by weight [25–500 ppm], and more preferably 25–200 parts by weight [25–200 ppm].

Sources of cerium ion include nitrates such as cerium [III] nitrate, ammonium cerium [IV] nitrate, etc., sulfates such as cerium [III] sulfate, cerium [IV] sulfate, etc., halides such as cerium [III] chloride, cerium [III] bromide, etc., and particularly cerium nitrates are preferable.

The surface treatment chemical [surface treatment bath] of the present invention further contains zirconium ion. The sources of zirconium ion include $H_2ZrF_6$, $[NH_4]_2ZrF_6$, $Na_2ZrF_6$, $K_2ZrF_6$, $Zr[NO_3]_4$, $ZrO[NO_3]_2$, $Zr[SO_4]_2$, $ZrOSO_4$, etc., and particularly $[NH_4]_2ZrF_6$ is preferable. The content of zirconium ion is 10–500 parts by weight [10–500 ppm]. When it is less than 10 parts by weight [10 ppm], a conversion coating-forming rate is extremely low, failing to produce a sufficient conversion coating. However, even though it exceeds 500 parts by weight [500 ppm], further effects cannot be obtained. Thus, from the economic point of view, it would be sufficient if it is up to 500 parts by weight [500 ppm]. In a case where vanadium ion is contained in the surface treatment chemical [surface treatment bath], the preferred content of zirconium ion is 20–100 parts by weight [20–100 ppm]. On the other hand, in a case where cerium ion is contained, the preferred content of zirconium ion is 20–500 parts by weight [20–500 ppm].

The surface treatment chemical [surface treatment bath] of the present invention further contains 10–500 parts by weight [10–500 ppm] of phosphate ion. When the content of phosphate ion is less than 10 parts by weight [10 ppm], the formed conversion coating has poor adhesion to a polymer coating film. On the other hand, when it exceeds 500 parts by weight [500 ppm], the formed conversion coating becomes poor in resistance to blackening by boiling water and adhesion to a polymer coating film, and further Zr.V.Al-$PO_4$ tends to be precipitated in the surface treatment bath. The preferred content of phosphate ion is 25–200 parts by weight [25–200 ppm]. The sources of phosphate ion include $H_3PO_4$, $NaH_2PO_4$, $[NH_4]H_2PO_4$, etc., and particularly $H_3PO_4$ is preferable.

The surface treatment chemical [surface treatment bath] of the present invention further contains 1–50 parts by weight [1–50 ppm] of effective fluorine ion. When the content of effective fluorine ion is less than 1 part by weight [1 ppm], substantially no etching reaction of aluminum takes place, failing to form a conversion coating. On the other hand, when it exceeds 50 parts by weight [50 ppm], the aluminum etching rate becomes higher than conversion coating-forming rate, deterring the formation of the conversion coating. In addition, even though a conversion coating is formed, it is poor in resistance to blackening by boiling water and adhesion to a polymer coating film. Incidentally, the term "effective fluorine ion" means isolated fluorine ion, and its concentration can be determined by measuring a treatment solution by a meter with a fluorine ion electrode. Thus, fluoride compounds from which fluorine ion is not isolated in the surface treatment solution cannot be regarded as the sources of effective fluorine ion. The sources of effective fluorine ion include HF, $NH_4F$, $NH_4HF_2$, NaF, $NaHF_2$, etc., and particularly HF is preferable.

The surface treatment bath is generally produced by diluting the surface treatment chemical to a proper concentration. The resulting surface treatment bath should have pH of 2.0–4.0. When the pH of the surface treatment bath is lower than 2.0, too much etching reaction of aluminum takes place, deterring the formation of the conversion coating. On the other hand, when it exceeds 4.0, Zr.V.Al-$PO_4$ tends to be precipitated. The preferred pH of the surface treatment bath is 2.7–3.3.

The pH of the surface treatment bath may be controlled by pH-adjusting agents. The pH-adjusting agents are preferably nitric acid, sulfuric acid, etc. Phosphoric acid can serve as a pH-adjusting agent, but it should be noted that it cannot be added in an amount exceeding the above range because it acts to deteriorate the properties of the resulting conversion coating.

The surface treatment chemical [surface treatment bath] of the present invention may optionally contain organic chelating agent of aluminum such as gluconic acid [or its salt], heptonic acid [or its salt], etc.

The surface treatment chemical of the present invention may be prepared by adding the above components to water as an aqueous concentrated solution, and it may be diluted by a proper amount of water to a predetermined concentration with its pH adjusted, if necessary, to provide the surface treatment bath of the present invention.

The application of the surface treatment bath to aluminum or its alloy can be conducted by any methods such as an immersion method, a spraying method, a roll coat method, etc. The application is usually conducted between room temperature and 50° C., preferably at a temperature of 30°–40° C. The treatment time may vary depending upon the treatment method and the treatment temperature, but it is usually as short as 5–60 sec. Incidentally, aluminum or its alloy to which the surface treatment bath of the present invention is applicable includes aluminum, aluminum-copper alloy, aluminum-manganese alloy, aluminum-silicon alloy, aluminum-magnesium alloy, aluminum-magnesium-silicon alloy, aluminum-zinc alloy, alulminum-zinc-magnesium alloy, etc. It may be used in any shape such as a plate, a rod, a wire, a pipe, etc. Particularly, the surface treatment bath of the present invention is suitable for treating aluminum cans for soft drinks, alcoholic beverages, etc.

By treating aluminum or its alloy with the surface treatment bath of the present invention, the aluminum is etched with effective fluorine ion, and forms a double salt with vanadium or cerium ion, zirconium ion, phosphate ion and fluorine ion, thereby forming a conversion coating. It is presumed that zirconium serves as an accelerator of the precipitation of vanadium or cerium. As a result, vanadium or cerium exists in a relatively large proportion in the resulting conversion coating, and a surface layer of the conversion coating shows high corrosion resistance because of the corrosion resistance of vanadium or cerium. Thus, it is not blackened at all even after immersion in boiling water for 30 minutes. When the conversion coating is further printed or painted, the conversion coating shows extremely high adhesion to such a polymer coating film. This high adhesion seems to be derived from interaction of vanadium or cerium and the polymer coating film. Thus, by the interaction of vanadium or cerium ion, zirconium ion, phosphate ion and effective fluorine ion, a conversion coating with good corrosion resistance, high resistance to blackening by boiling water and slidability can be obtained.

The present invention will be explained in further detail by the following Examples and Comparative Examples. In the Examples and Comparative Examples, resistance to blackening by boiling water, adhesion to a polymer coating film and slidability are evaluated as follows:

[1] Resistance to blackening by boiling water

Each aluminum can treated with a surface treatment bath is dried, and a bottom portion is cut off from the can, and then immersed in boiling water at 100° C. for 30 minutes. After that, the degree is evaluated as follows:

◎ : Not blackened at all.
○ : Extremely slightly blackened.
Δ: Slightly blackened.
X: Considerably blackened.
XX: Completely blackened.

[2] Adhesion to polymer coating film

Each aluminum can treated with a surface treatment bath is dried, and its outer surface is further coated with epoxy-phenol paint [Finishes A, manufactured by Toyo Ink Manufacturing Co., Ltd.] and then baked. A polyamide film of 40 μm in thickness [Diamide Film #7000 manufactured by Daicel Chemical Industries, Ltd.] is interposed between two of the resulting coated plates and subjected to hot pressing. A 5-mm wide test piece is cut off from the hot pressed plates, and to evaluate the adhesion of each test piece, its peel strength is measured by a T-peel method and a 180° peel method. The unit of the peel strength is kgf/5 mm. Incidentally, the adhesion measured on a test piece before immersion in boiling water is called "primary adhesion," and the adhesion measured on a test piece after immersion in running water at 90° C. for 7.5 hours is called "secondary adhesion."

[3] Slidability

As shown in FIG. 1, two surface-treated aluminum cans 2, 2' are fixed to a sliding plate 1 whose inclination angle $\theta$ can be changed, with a double-sided adhesive tape in such a manner that bottoms 3, 3' of the aluminum cans 2, 2' face downward. Two additional surface-treated aluminum cans 4, 4' are placed on the aluminum cans 2, 2' perpendicularly in such a manner that each bottom 5, 5' of the cans 4, 4' faces oppositely, and that lines by rolling is directed vertically. Further, the two cans 4, 4' are fixed to each other with a double-sided adhesive tape in side portions not in contact with the lower cans 2, 2'.

By raising the sliding plate 1 to increase its inclination angle $\theta$, an angle $\theta$ at which the upper two cans 4, 4' start to slide is measured. A friction constant is calculated from tan $\theta$. The friction coefficient is evaluated as follows:

◎ : less than 0.7
○ : 0.7 or more and less than 0.8
Δ: 0.8 or more and less than 0.9
X: 0.9 or more and less than 1.0
XX: 1.0 or more

EXAMPLES 1-10, COMPARATIVE EXAMPLES 1-8

An aluminum sheet [JIS-A-3004] is formed into a can by a Drawing & Ironing method, and degreased by spraying an acidic cleaner [Ridoline NHC 100 manufactured by Nippon Paint Co., Ltd.]. After washing with water, it is sprayed with a surface treatment bath having the composition and pH shown in Table 1 at 40° C. for 30 sec. Next, it is washed with water and then with deionized water, and then dried in an oven at 200° C. After drying, each can is tested with respect to resistance to blackening by boiling water, adhesion to a polymer coating film and slidability. The results are shown in Table 2.

TABLE 1

| No. | Vanadium Ion(1) (ppm) | Zirconium Ion(2) (ppm) | Phosphate Ion(3) (ppm) | Effective Fluorine Ion(4) (ppm) | pH(5) |
|---|---|---|---|---|---|
| Example | | | | | |
| 1 | 50 | 45 | 70 | 8 | 3.0 |
| 2 | 25 | 45 | 70 | 8 | 3.0 |
| 3 | 50 | 20 | 70 | 8 | 3.0 |
| 4 | 50 | 45 | 25 | 8 | 3.0 |
| 5 | 50 | 45 | 200 | 8 | 3.0 |
| 6 | 50 | 45 | 70 | 3 | 3.0 |
| 7 | 50 | 45 | 70 | 20 | 3.0 |
| 8 | 50 | 45 | 70 | 8 | 2.7 |
| 9 | 50 | 45 | 70 | 8 | 3.3 |
| 10 | 25 | 20 | 25 | 8 | 3.0 |
| Comparative Example | | | | | |
| 1 | 5 | 45 | 70 | 8 | 3.0 |
| 2 | 50 | 5 | 70 | 8 | 3.0 |
| 3 | 50 | 45 | 5 | 8 | 3.0 |
| 4(6) | 50 | 45 | 70 | 0.3 | 3.0 |
| 5 | 50 | 45 | 70 | 8 | 1.8 |
| 6(6) | 50 | 45 | 70 | 8 | 4.2 |
| 7 | 0 | 45 | 70 | 8 | 3.0 |
| 8 | 50 | 0 | 70 | 8 | 3.0 |

Note
(1)Added as $NH_4VO_3$.
(2)Added as $(NH_4)_2ZrF_6$.
(3)Added as $H_3PO_4$.
(4)Added as HF.
(5)Controlled with $HNO_3$ and an ammonium aqueous solution.
(6)Turned cloudy.

TABLE 2

| No. | Resistance to Blackening by Boiling Water | Adhesion of Coating Film: T-Peel Method Prim. | T-Peel Method Sec. | 180°-Peel Method Prim. | 180°-Peel Method Sec. | Slidability |
|---|---|---|---|---|---|---|
| Example | | | | | | |
| 1 | ◎ | 5.3 | 2.5 | 4.3 | 2.9 | Δ |
| 2 | ○ | 4.9 | 2.4 | 4.5 | 3.0 | ○ |
| 3 | ◎ | 4.3 | 2.0 | 4.2 | 2.8 | ○ |
| 4 | ◎ | 4.4 | 2.1 | 4.1 | 2.6 | ○ |
| 5 | ○ | 4.2 | 2.1 | 4.2 | 2.6 | ○ |
| 6 | ◎ | 4.8 | 2.3 | 4.4 | 2.8 | ○ |
| 7 | ◎ | 4.8 | 2.4 | 4.4 | 3.0 | ○ |
| 8 | ◎ | 5.0 | 2.3 | 4.4 | 3.1 | ○ |
| 9 | ◎ | 5.1 | 2.3 | 4.3 | 3.0 | ○ |
| 10 | ◎ | 5.1 | 2.4 | 4.2 | 3.0 | ○ |
| Comparative Example | | | | | | |
| 1 | X | 2.2 | 0.7 | 2.5 | 1.6 | X |

TABLE 2-continued

| No. | Resistance to Blackening by Boiling Water | Adhesion of Coating Film: T-Peel Method Prim. | T-Peel Method Sec. | 180°-Peel Method Prim. | 180°-Peel Method Sec. | Slidability |
|---|---|---|---|---|---|---|
| 2 | XX | 0.7 | 0.3 | 2.0 | 0.8 | X |
| 3 | X | 2.0 | 0.6 | 2.3 | 1.6 | Δ |
| 4 | XX | 0.6 | 0.3 | 2.1 | 0.6 | X |
| 5 | Δ | 2.1 | 0.6 | 2.3 | 1.5 | Δ |
| 6 | Δ | 1.9 | 0.5 | 2.0 | 0.9 | Δ |
| 7 | X | 2.0 | 0.7 | 2.4 | 1.6 | X |
| 8 | XX | 0.6 | 0.3 | 1.8 | 0.8 | Δ |

As is clear from the above results, in the case of treatment with the surface treatment bath of the present invention [Examples 1-10], the formed conversion coatings are good in resistance to blackening by boiling water, adhesion to a polymer coating film and slidability. On the other hand, when the vanadium ion is less than 10 ppm [10 parts by weight] [Comparative Examples 1 and 7], the formed conversion coatings are poor in resistance to blackening by boiling water, adhesion to a polymer coating film and slidability. And when zirconium is less than 10 ppm [10 parts by weight] [Comparative Examples 2 and 8], and when effective fluorine ion is less than 1 ppm [1 parts by weight] [Comparative Example 4], sufficient conversion coatings are not formed, and they are poor in resistance to blackening by boiling water, adhesion to a polymer coating film and slidability. Incidentally, in Comparative Example 4, the treating bath becomes cloudy by precipitation. Further, when phosphate ion is less than 10 ppm [10 parts by weight] [Comparative Example 3], the resulting conversion coating is poor in resistance to blackening by boiling water and adhesion to a polymer coating film. When the pH of the surface treatment bath is less than 2.0 [Comparative Example 5], a conversion coating is not easily formed, and the formed conversion coating is slightly blackened and shows poor adhesion to a polymer coating film. On the other hand, when the pH exceeds 4.0 [Comparative Example 6], the treating bath becomes cloudy because of precipitation, and the resulting conversion coating is slightly poor in resistance to blackening by boiling water and also shows poor adhesion to a polymer coating film.

EXAMPLES 11-20, COMPARATIVE EXAMPLES 9-16

The surface treatment of aluminum sheets is conducted in the same manner as in Examples 1-10 and Comparative Examples 1-8 except for using surface treatment baths having the compositions and pH shown in Table 3, and resistance to blackening by boiling water, adhesion to a polymer coating film and slidability are tested on the resulting conversion coatings. The results are shown in Table 4.

TABLE 3

| No. | Cerium Ion (1) (ppm) | Zirconium Ion (2) (ppm) | Phosphate Ion (3) (ppm) | Effective Fluorine Ion (4) (ppm) | pH(5) |
|---|---|---|---|---|---|
| Example | | | | | |
| 11 | 50 | 50 | 50 | 8 | 3.0 |
| 12 | 25 | 50 | 50 | 8 | 3.0 |
| 13 | 50 | 25 | 50 | 8 | 3.0 |
| 14 | 50 | 50 | 25 | 8 | 3.0 |
| 15 | 50 | 50 | 200 | 8 | 3.0 |
| 16 | 50 | 50 | 50 | 3 | 3.0 |
| 17 | 50 | 50 | 50 | 20 | 3.0 |

TABLE 3-continued

| No. | Cerium Ion (1) (ppm) | Zirconium Ion (2) (ppm) | Phosphate Ion (3) (ppm) | Effective Fluorine Ion (4) (ppm) | pH(5) |
|---|---|---|---|---|---|
| 18 | 50 | 50 | 50 | 8 | 2.7 |
| 19 | 50 | 50 | 50 | 8 | 3.3 |
| 20 | 25 | 25 | 25 | 8 | 3.0 |
| Comparative Example | | | | | |
| 9 | 5 | 50 | 50 | 8 | 3.0 |
| 10 | 50 | 5 | 50 | 8 | 3.0 |
| 11 | 50 | 50 | 5 | 8 | 3.0 |
| 12 | 50 | 50 | 50 | 0.3 | 3.0 |
| 13 | 50 | 50 | 50 | 8 | 1.8 |
| 14 | 50 | 50 | 50 | 3 | 4.2 |
| 15 | 0 | 50 | 50 | 20 | 3.0 |
| 16 | 50 | 0 | 50 | 8 | 3.0 |

Note
(1)Added as $Ce(NH_4)_2(NO_3)_6$.
(2)Added as $(NH_4)_2ZrF_6$.
(3)Added as $H_3PO_4$.
(4)Added as HF.
(5)Controlled with $HNO_3$ and an ammonium aqueous solution.

TABLE 4

| No. | Resistance to Blackening by Boiling Water | Adhesion of Coating Film: T-Peel Method Prim. | T-Peel Method Sec. | 180°-Peel Method Prim. | 180°-Peel Method Sec. | Slidability |
|---|---|---|---|---|---|---|
| Example | | | | | | |
| 11 | ◎ | 4.7 | 2.2 | 4.0 | 2.7 | Δ |
| 12 | ○ | 4.6 | 2.3 | 4.1 | 2.8 | ○ |
| 13 | ◎ | 4.1 | 2.0 | 4.0 | 2.6 | ○ |
| 14 | ◎ | 4.5 | 2.1 | 3.9 | 2.4 | ○ |
| 15 | ○ | 4.0 | 2.2 | 3.9 | 2.5 | ○ |
| 16 | ◎ | 4.4 | 2.3 | 4.3 | 2.6 | ○ |
| 17 | ◎ | 4.2 | 2.3 | 4.2 | 2.7 | ○ |
| 18 | ◎ | 4.7 | 2.2 | 4.2 | 3.0 | ○ |
| 19 | ◎ | 4.6 | 2.4 | 4.1 | 2.8 | ○ |
| 20 | ◎ | 4.4 | 2.2 | 4.0 | 2.7 | ○ |
| Comparative Example | | | | | | |
| 9 | X | 2.2 | 0.7 | 2.5 | 1.6 | X |
| 10 | XX | 0.7 | 0.3 | 2.0 | 0.8 | X |
| 11 | X | 2.0 | 0.5 | 2.3 | 1.5 | Δ |
| 12 | XX | 0.7 | 0.3 | 2.2 | 0.7 | X |
| 13 | Δ | 2.2 | 0.6 | 2.2 | 1.6 | Δ |
| 14 | Δ | 1.9 | 0.6 | 2.0 | 0.8 | Δ |
| 15 | X | 2.0 | 0.7 | 2.4 | 1.6 | X |
| 16 | XX | 0.6 | 0.3 | 1.8 | 0.9 | X |

As is clear from the above results, in the case of treatment with the surface treatment bath of the present invention [Examples 11-20], the formed conversion coatings are good in resistance to blackening by boiling water, adhesion to a polymer coating film and slidability. On the other hand, when the cerium ion is less than 10 ppm [10 parts by weight] [Comparative Examples 9 and 15], the formed conversion coatings are poor in resistance to blackening by boiling water, adhesion to a polymer coating film and slidability. And when zirconium is less than 10 ppm [10 parts by weight] [Comparative Examples 10 and 16], and when effective fluorine ion is less than 1 ppm [1 parts by weight] [Comparative Example 12], sufficient conversion coatings are not formed, and they are poor in resistance to blackening by boiling water, adhesion to a polymer coating film and slidability. Incidentally, in Comparative Example 12, the treating bath becomes cloudy by precipitation. Further, when phosphate ion is less than 10 ppm [10 parts by weight] [Comparative Example 11], the resulting conversion coating is poor in resistance to blackening by boiling water and adhesion to a polymer coating film. When the pH of the surface treatment bath is less than 2.0 [Comparative Example 13], a conversion coating is not easily formed, and the formed conversion coating is slightly blackened and shows poor adhesion to a polymer coating film. On the other hand, when the pH exceeds 4.0 [Comparative Example 14], the treating bath becomes cloudy because of precipitation, and the resulting conversion coating is slightly poor in resistance to blackening by boiling water and also shows poor adhesion to a polymer coating film.

As described above in detail, with the surface treatment chemical [surface treatment bath] of the present invention, a conversion coating having extremely high corrosion resistance can be formed on a surface of aluminum or its alloy in a very short time. The conversion coating thus formed is highly resistant to blackening even when immersed in boiling water, meaning that it has excellent resistance to blackening by boiling water even in a thin layer. In addition, when an upper polymer coating film is formed on the conversion coating by painting or printing, extremely strong bonding between them can be achieved. Further, since the conversion coating shows good slidability, it is extremely advantageous in conveying.

Since the surface treatment chemical [surface treatment bath] of the present invention shows sufficient characteristics even though its concentration is varied, it is not required to strictly control the concentration of the surface treatment bath.

The surface treatment chemical [surface treatment bath] having such advantages are highly suitable for surface treatment of aluminum cans, etc.

What is claimed is:

1. A surface treatment chemical for aluminum or an alloy of aluminum which consists essentially of 10–1000 parts by weight of vanadium or cerium ion, 10–500 parts by weight of zirconium ion, 10–500 parts by weight of phosphate ion and 1–50 parts by weight of effective fluorine ion; which surface treatment chemical is capable of being diluted to a pH of 2.0–4.0.

2. The surface treatment chemical according to claim 1, wherein said vanadium ion is 25–500 parts by weight, said zirconium ion is 20–100 parts by weight, said phosphate ion is 25–200 parts by weight, and said effective fluorine ion is 3–20 parts by weight.

3. The surface treatment chemical according to claim 1, wherein said cerium ion is 25–500 parts by weight, said zirconium ion is 20–500 parts by weight, said phosphate ion is 25–200 parts by weight, and said effective fluorine ion is 3–20 parts by weight.

4. A surface treatment bath for aluminum or its alloy consisting essentially 10–1000 ppm of vanadium or cerium ion, 10–500 ppm of zirconium ion, 10–500 ppm of phosphate ion and 1–50 ppm of effective fluorine ion, and having a pH of 2.0–4.0, which surface treatment bath is obtained by diluting the surface treatment chemical of claim 1 with water.

5. The surface treatment bath according to claim 4, wherein said vanadium ion is 25–500 ppm, said zirconium ion is 20–100 ppm, said phosphate ion is 25–200 ppm, and said effective fluorine ion is 3–20 ppm, and said bath has a pH of 2.7–3.3.

6. The surface treatment bath according to claim 4, wherein said cerium ion is 25–500 ppm, said zirconium ion is 20–500 ppm, said phosphate ion is 25–200 ppm, and said effective fluorine ion is 3–20 ppm, and said bath has pH of 2.7–3.3.

7. The surface treatment chemical according to claim 1 wherein said vanadium is present.

8. The surface treatment chemical according to claim 1 wherein said cerium is present.

9. The surface treatment bath according to claim 4 wherein said vanadium is present.

10. The surface treatment bath according to claim 4 wherein said cerium is present.

* * * * *